United States Patent [19]

Perkins

[11] 4,059,004

[45] Nov. 22, 1977

[54] METHOD OF FORMING HELICALLY CORRUGATED TUBING

[75] Inventor: Robert W. Perkins, Hamden, Conn.

[73] Assignee: Spiral Tubing Corporation, New Britain, Conn.

[21] Appl. No.: 659,845

[22] Filed: Feb. 20, 1976

[51] Int. Cl.[2] ..... B21D 11/14

[52] U.S. Cl. ..... 72/299; 72/371

[58] Field of Search ..... 72/299, 371, 298

[56] References Cited

U.S. PATENT DOCUMENTS

| | | | |
|---|---|---|---|
| 2,569,850 | 10/1951 | Falconer | 72/299 X |
| 2,729,266 | 1/1956 | Humphrey | 72/299 |
| 3,015,355 | 1/1962 | Humphrey | 72/299 |
| 3,533,267 | 10/1970 | Bunnell | 72/299 |

*Primary Examiner*—Leon Gilden

*Attorney, Agent, or Firm*—McCormick, Paulding & Huber

[57] ABSTRACT

Helical corrugations are formed in a tube having a cylindrical wall by generating pressure radially of the unsupported tube wall at localized areas distributed around the tube circumference. While the radial pressure is being generated, twisting of the tube about its own axis is initiated and as a result, radial deformation of the unsupported tube wall takes place. By controlling the axial length of the tube while it is twisted, the radial deformations develop into flutes which grow axially along a selected helical path in the tube wall.

17 Claims, 4 Drawing Figures

METHOD OF FORMING HELICALLY CORRUGATED TUBING

BACKGROUND OF THE INVENTION

The present invention relates to an improved method of forming helical corrugations in the walls of a cylindrical tube.

U.S. Pat. No. 3,015,355 issued to A. H. Humphrey discloses a method for forming spirally ribbed or helically corrugated tubing in which method a straight walled cylindrical tube, without corrugations, is deformed by radially offsetting the tube wall in selected spots to change the torsional resistance, and then twisting the tube in a turning or twisting machine such as a lathe having a rotatable headstock and a non-rotatable tailstock movable axially toward and away from the headstock. When the tube is twisted in the machine and the axial length of the tube is controlled at the same time, the radial deformations in the tube wall grow axially along a helical path in the tube wall in accordance with the axial and rotational motions of the head and tailstocks.

As described in the referenced patent, the method for forming helical corrugations requires that the radial deformations be generated in the tube wall before the tube is placed in the twisting machine. The operation of generating such deformations necessitates special preparation of the tube prior to insertion in the twisting machine and represents an additional, time-consuming step in the manufacturing of such corrugated tubing. The formation of dimples or other radial deformations must be carried out in a work area distinct from that of the twisting machine and then the tubing with the deformations must be transferred from that work area to the machine for completion of the corrugation-forming process. In addition to a separate work area for forming the dimples, specialized tools and fixtures such as shown in U.S. Pat. No. 3,533,267 issued to Bunnell are required to hold the tubing during the dimple-forming steps. In all, the special preparation of the tube prior to installation in the twisting machine comprises a significant portion of the overall manufacturing process even though the dimples represent a relatively insignificant distortion of the tube walls in comparison to the corrugations which are eventually formed.

It is, accordingly, a general object of the present invention to simplify the prior art process of manufacturing helically corrugated tubes by eliminating the special preparatory operation in which dimples or other radial deformations are impressed in the walls of the tube prior to installation in the twisting machine.

SUMMARY OF THE INVENTION

The present invention resides in a simplified process of manufacturing helically corrugated tubing and represents an improvement over the prior art.

In accordance with the present invention, the corrugation-forming process is started with a section of deformable tube having a cylindrical wall. The cylindrical wall is without any special deformations and thus, the tube section represents nothing more than a section of tube as it may be purchased or cut from conventional tube stock. In this respect, the term cylindrical or cylinder as used in this specification refers to a closed shape generated by a moving line or element held everywhere parallel to a stationary line called the axis, and includes shapes having circular, oval, hexagonal and other cross sections.

One axial end of the tube section is then twisted relative to the other end and, at the same time, localized pressure is generated radially of the cylindrical walls at selected areas spaced circumaxially around the otherwise cylindrical tube. The localized pressure is applied at the beginning of the step of twisting to initiate radial deformation of the tube wall at the pressurized areas. The pressure applied must be sufficient to reduce the torsional resistance of the tube wall at the localized areas but need not be of such a level that the tube wall is permanently deformed as in the prior art processes. The number of localized areas pressurized in the wall of the tube corresponds to the number of flutes desired in the corrugations to be formed.

One method of applying radially inward pressure at different areas around the tube is to provide pimples or protrusions on the jaws of the chuck in the twisting machine. The pimples are sized to engage the tube walls at the areas to be pressurized when the tube is clamped in the chuck at the beginning of a twisting operation.

Controlling the axial length of the tube during the step of twisting causes the radial deformations to grow axially from the pressurized areas along a selected helical path in the cylindrical tube wall.

The depth of the corrugations may be controlled by inserting a cylindrical mandrel into the tube prior to the step of twisting. As the cylindrical wall deforms radially inward, the mandrel is engaged and thus limits the depth of the flutes. By providing the mandrel with an enlarged portion having a diameter substantially equal to the inside diameter of the tube, and placing the enlarged portion immediately adjacent the pressurized areas, the growth of the corrugations may be directed axially along the tube away from the enlarged portion of the mandrel.

By applying radially directed pressure to the localized areas around the tube as the twisting step in initiated, the requirement for preparing the tube with radial deformations before twisting is eliminated. Thus, the manufacture of tubing with helical corrugations is greatly simplified because the same jaws which grasp the tube during a twisting operation may be utilized to apply localized pressure and thereby initiate growth of corrugations along the tube.

DESCRIPTION OF THE PREFERRED EMBODIMENTS

Figure 1:
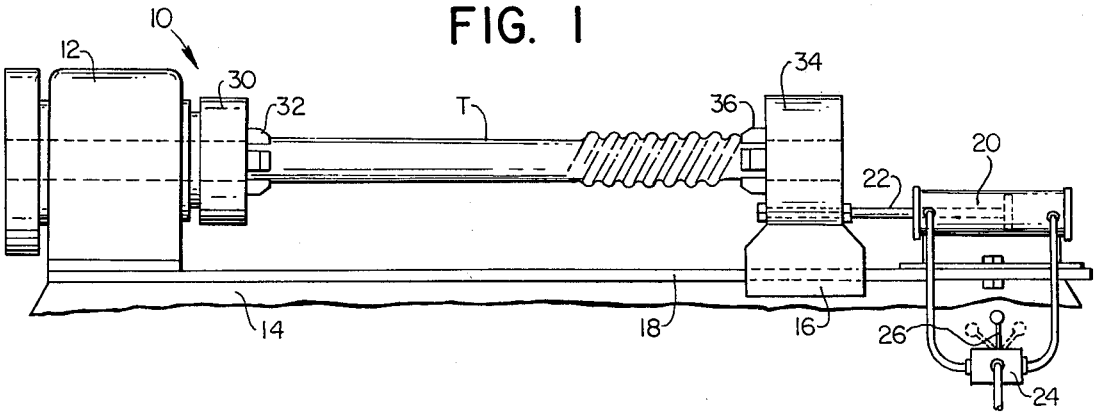
FIG. 1 is a side elevation view of a twisting machine for helically corrugating a tube and illustrates a tube having corrugations along one portion.

The improved process for forming corrugations in a cylindrical tube is carried out in one case in a twisting machine such as the lathe 10 illustrated in FIG. 1. The lathe includes a headstock 12 which is fixedly secured to a machine frame 14 and a tailstock 16 which is mounted on the frame 14 by means of ways 18 so that the tailstock 16 may be shifted toward and away from the headstock 12. Movement of the tailstock 16 is regulated by an actuator 20 fixed to the frame 14 and having a movable piston rod 22 connected with the tailstock 16. A control valve 24 regulates the flow of hydraulic or pneumatic fluid to the actuator 20 and the valve may be manually controlled by means of the handle 26 or alternatively an automatic control may be provided.

The headstock 12 has a rotatable chuck 30 bearing a plurality of clamping jaws 32 which engage and twist a tube T about its longitudinal axis to develop the desired corrugations. The tailstock 16 has a non-rotatable chuck 34 in axial alignment with the rotatable chuck 30 and bears a plurality of clamping jaws 36 for engaging the end of the tube T opposite that engaged in the jaws 32. Preferably, the headstock 12 or the tailstock 16 or both define an open bore so that the tube T may be installed through one or the other of the stocks.

Figure 2:
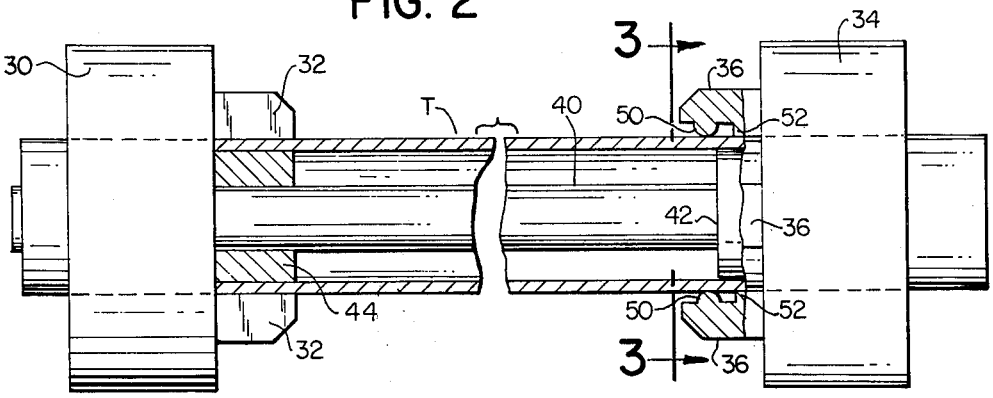
FIG. 2 is a partially sectioned view of the headstock and tailstock in the twisting machine of FIG. 1 and illustrates in detail the jaws of the tailstock for developing localized pressures on the tube wall at the beginning of a twisting operation.
Figure 3:
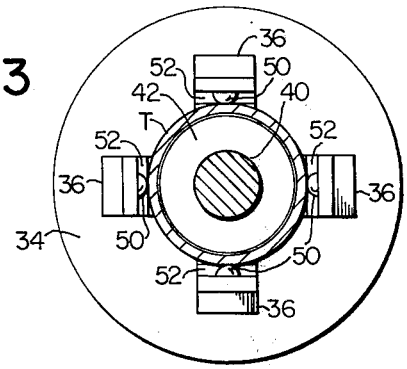
FIG. 3 is an axial view of the tailstock as seen along the sectioning line 3—3 in FIG. 2.

When the tube T is installed in the lathe 10, a mandrel 40 is placed within the tube as shown in FIGS. 2 and 3. In one embodiment, the mandrel 40 has a diameter less than the inside diameter of the tube along substantially its entire length except for an enlarged end portion 42 which has a diameter substantially equal to the inside diameter of the tube. The enlarged end portion 42 is placed within the tube portion engaged by the jaws 36 and prevents corrugations from developing in the stressed portion of the tube wall within which the enlarged portion is located. The remaining portion of the mandrel having the reduced diameter limits the radial depth of the corrugations developed during the twisting process. The end of the mandrel opposite the enlarged portion 42 is held coaxially within the tube by means of a bushing 44. The bushing 44 permits the mandrel to slide relative to the headstock 12 as the tailstock 16 is moved axially toward the headstock during a twisting operation. The bushing 44, however, is not essential since the corrugations which are formed in the tube during a twisting operation tend to develop coaxially.

The prior art methods of forming helical corrugations in a tube with a twisting machine such as the lathe 10 require that the tube walls be radially deformed or dimpled prior to installation of the tube in the machine. Permanently deforming the tube wall at evenly spaced points on the tube circumference reduces the resistance to torsion and causes the radial deformations to grow axially from each of the deformed spots as the tube is twisted between the headstock 12 and tailstock 16 and the axial length of the tube is controlled simultaneously. The flutes formed by the deformations develop axially along helical paths and the pitch of the flutes is controlled by coordinating the rotation of the headstock with the axial translation of the tailstock.

In accordance with the present invention, the prior art step of radially deforming the tube wall prior to installation in the twisting machine is eliminated and instead, radially directed pressure is generated at localized areas on the circumference of the tube as the step of twisting is initiated. The localized area at which the pressure is generated corresponds to one flute to be formed in the corrugations. Thus, the localized areas are normally distributed equally about the tube circumference at a given axial station subjected to twisting. The level of pressure applied to each area must be sufficient to reduce the resistance of the tube wall to torsion so that a flute will develop when the tube wall is twisted. But the pressure level need not be so high that the tube wall is permanently deformed by the radial pressure alone. The pressure developed may be directed radially outward; however, it is contemplated in a preferred embodiment of the invention that the pressure be directed radially inward by, for example, the jaws of a chuck engaging the tube during twisting.

In the twisting machine illustrated in FIGS. 1–3, the jaws 36 are utilized to develop the localized pressure at circumaxially spaced areas on the outside of the tube and for this purpose each of the jaws is provided with a protrusion or pimple 50 which engages the tube and provides radially inward pressure on a portion of the tube wall which is unsupported internally when the jaws are closed on the tube. Each of the jaws also includes a shoe portion 52 which has a substantially larger surface area than the pimple 50 and which serves as the principal engaging element of each jaw for restraining torsional rotation of the tube within the chuck 34. The pimples 50 preferably project radially inward slightly farther than the shoe portions 52 and have a substantially smaller engagement area with the tube than the shoe portions to insure a local pressurizing and stressing of the tube wall. Due to the inwardly directed pressure provided by the pimples 50, a valley between two flutes will emanate from each of the pimples as the tube is twisted and a peak of each flute will grow axially of the tube along a helical path originating from points midway between each of the jaws 36. Thus, each of the locally pressurized area corresponds respectively to a flute which grows axially along the tube.

It will be noted in FIG. 2 that the enlarged portion 42 of the mandrel 40 mates with the reduced portion at an axial station of the tube adjacent the pressurized areas and between the pimples 50 and the shoe portions 52. Since the enlarged portion 42 has substantially the same outside diameter as the inside diameter of the tube, the growth of flutes due to the pimples 50 is impeded in the twisting portion of the tube wall between the pimples and shoe portions 52. Correspondingly, the growth is directed axially away from the non-rotatable chuck 34 toward the rotatable chuck 30.

Figure 4:
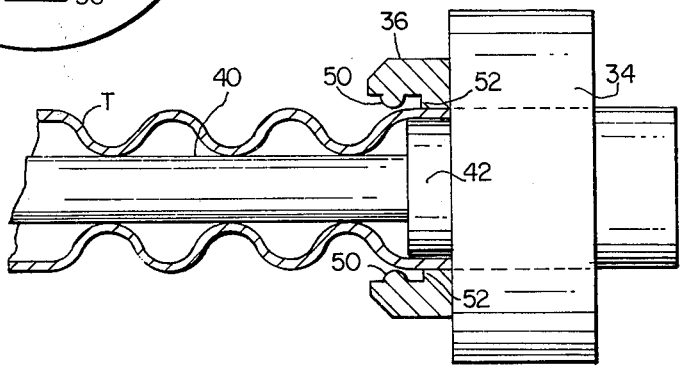
FIG. 4 is a partially sectioned view of the tailstock similar to FIG. 2 and illustrates corrugations formed in the tube after the twisting operation has been initiated.

FIG. 4 illustrates the flutes growing axially away from the chuck 34 as the twisting of the tube is continued. It will also be noted that the pressures generated by the pimples 50 may be relieved and possible disengagement of the pimples from the tube wall may occur as the flutes develop. Such relief or disengagement does not interfere with the progressive development of the flutes along the tube once growth of the flutes has started, because the growth at one station along the tube depends upon the weakening and deformation of the tube wall at an immediately adjacent station rather than the weakening at the station where the flutes were initiated. It will also be observed that the portion of the mandrel 40 having a reduced diameter limits the radially inward deformation so that the depth of the flutes is controlled along the length of the tube.

After the corrugations have been formed in the tube, the mandrel 40 and the tube are frequently pressed tightly together which prevents or inhibits removal of the mandrel. To relieve the pressure, the tube is untwisted to a limited degree by, for example, rotating one end of the tube relative to the other in the direction opposite that used to produce the corrugations. For a more detailed explanation of the various methods by which this untwisting may be accomplished, reference may be made to U.S. Pat. No. 3,533,267 cited above.

Thus, a method of forming helical corrugations in a tube wall has been disclosed in which the prior art step of radially deforming the tube wall prior to installation in the twisting machine is eliminated. In accordance with the present invention, pressure is generated at localized areas on the circumference of the tube to lower the torsional resistance at the areas. As twisting is initiated and the axial length of the tube is controlled, flutes forming the corrugations grow axially along the tube.

While the present invention has been described in a preferred embodiment, it should be understood that numerous modifications and substitutions can be made in the process without departing from the spirit of the invention. For example, it should be recognized that although the localized pressures were generated by the chuck which holds the tube at one end, a free-rotating chuck or clamp might be mounted on the tube in the machine to generate the pressures at any station along the tube between he chucks 30 and 34. Thus, a free-rotating chuck mounted at the midpoint of the tube in FIG. 1 could be used to generate localized pressures from which flutes would grow axially in each direction toward the chucks 30 and 34. Growth of the flutes in one axial direction could be impeded by providing a mandrel 40 with an enlarged diameter in that portion of the tube in which the flutes are not desired. Accordingly, the present invention has been described in a preferred embodiment by way of illustration rather than limitation.

I claim:

1. A method of helically corrugating a section of deformable tube comprising the steps of:

providing a section of deformable tube having a cylindrical wall without deformations between the axial tube ends;

twisting one axial end of the tube section about the tube axis relative to the other axial end of the section;

generating localized pressure radially of the cylindrical wall at areas of the wall which are unsupported and which are distributed around the otherwise cylindrical tube while twisting the one axial end of the tube section relative to the other axial end to reduce the resistance to torsion and initiate radial deformation of the tube wall at the pressurized areas in conjunction with the step of twisting; and controlling the axial length of the tube section during the step of twisting to cause the radial deformations to grow from the pressurized areas axially along a selected helical path in the cylindrical tube wall.

2. A method as defined in claim 1 of helically corrugating a section of deformable tube having a circular cross section further including the step of inserting coaxially into the section of tube a cylindrical mandrel having a circular section and a portion defining a reduced diameter which is a predetermined amount less than the inside diameter of the tube, the reduced diameter portion being situated at least within the unsupported tube areas.

3. The method of corrugating as defined in claim 2 wherein the step of generating pressure comprises generating localized pressure at areas distributed around the otherwise cylindrical tube at one axial station along the tube section, and the step of inserting includes inserting a mandrel having a second portion adjacent the portion having the reduced diameter, the second portion having a diameter substantially equal to the inside diameter of the tube section and the step of inserting further includes placing the mandrel before the step of twisting with the second portion within the tube section axially adjacent said one axial station.

4. The method of corrugating a section of deformable tube as defined in claim 1 wherein the step of generating localized pressure radially of the cylindrical wall comprises generating inwardly directed pressures at local areas distributed around the outside of the cylindrical wall.

5. The method of corrugating a section of deformable tube as defined in claim 1 wherein the step of generating comprises generating at one axial station of the section, one locally pressurized area for each flute in the helical corrugations to be formed in the cylindrical tube wall.

6. The method of helically corrugating a section of deformable tube as defined in claim 1 wherein the step of generating localized pressure comprises generating such pressure at evenly spaced areas about the circumference of the tube at a given axial station between the axial ends of the tube section.

7. A method of forming helical corrugations in the wall of a deformable tube having a generally circular cross-section comprising the steps of:

applying radially directed pressure to the tube wall at localized and unsupported areas around the circumference of the tube, the areas corresponding to the flutes desired in the corrugations, to be formed; and initiating twisting of the deformable tube about its longitudinal axis while the radially directed pressure is applied to the localized areas to initiate deformation of the tube wall along helical lines emanating from the locally pressurized areas.

8. The method of forming helical corrugations of claim 7 additionally including the step of continuing the twisting of the tube after the step of initiating to extend the helical deformations and form the desired flutes along a selected portion of the tube.

9. A method of forming helical corrugations in a deformable tube as defined in claim 7 further including the step of controlling the axial length of the tube as the tube is twisted.

10. A method of forming helical corrugations in a deformable tube as defined in claim 7 further including the step of limiting the depth of penetration of the deformations radially inward of the tube wall as the tube is twisted.

11. The method of forming helical corrugations in a deformable tube as defined in claim 10 wherein the step of limiting comprises:

inserting within the tube a cylindrical mandrel having an outside diameter of one portion smaller than the inside diameter of the circular tube cross-section by a predetermined amount; and allowing the tube wall to deform radially inward to the one portion of the mandrel while the tube is twisted.

12. The method of forming helical corrugations in a deformable tube as defined in claim 7 wherein the step of applying radially directed pressure comprises applying localized pressure radially inward of the circular tube.

13. The method of forming helical corrugations as in claim 12 wherein the step of applying pressure radially inward of the tube comprises clamping the tube in the jaws of a chuck, said jaws having protrusions engaging the outside of the tube at the localized areas to apply the radially inward pressure.

14. The method of forming helical corrugations as in claim 13 wherein the step of initiating twisting also includes said step of clamping the tube in a chuck.

15. A method of forming helical corrugations in a deformable tube as defined in claim 7 wherein:

the step of applying comprises applying the radially directed pressure at equally spaced areas about the circumference of the tube; and the step of initiating twisting comprises gripping the tube at axially spaced stations on opposite sides of the equally spaced areas and rotating the tube at one station relative to the tube at the other station.

16. A method of helically corrugating a section of tube as defined in claim 1 wherein the step of generating localized pressure comprises applying the localized pressure at unsupported areas of the tube wall without permanently deforming the tube wall.

17. A method of forming helical corrugations in a deformable tube as defined in claim 7 wherein the step of applying radially directed pressure is comprised of applying pressure at a level sufficient to reduce the resistance of the tube wall to torsion when the tube is twisted but less than the level which permanently deforms the tube wall.

* * * * *